US008021814B2

(12) United States Patent
Hagi et al.

(10) Patent No.: US 8,021,814 B2
(45) Date of Patent: Sep. 20, 2011

(54) TONER, AND OILLESS FIXING METHOD AND PROCESS CARTRIDGE USING THE TONER

(75) Inventors: Masayuki Hagi, Minoh (JP); Yoshihiro Mikuriya, Nishinomiya (JP); Hideaki Yasunaga, Ibaraki (JP); Hiroaki Katoh, Nagaokakyo (JP); Kazuoki Fuwa, Toyonaka (JP); Yoshitaka Sekiguchi, Nishinomiya (JP); Satoshi Ogawa, Nara (JP); Masahide Inoue, Numazu (JP)

(73) Assignee: Ricoh Company Limited, Tokyo (JP)

( * ) Notice: Subject to any disclaimer, the term of this patent is extended or adjusted under 35 U.S.C. 154(b) by 726 days.

(21) Appl. No.: 12/051,248

(22) Filed: Mar. 19, 2008

(65) Prior Publication Data

US 2008/0233506 A1 Sep. 25, 2008

(30) Foreign Application Priority Data

Mar. 19, 2007 (JP) ..... 2007-069763

(51) Int. Cl.
*G03G 9/08* (2006.01)
*G03G 13/20* (2006.01)

(52) U.S. Cl. ..... 430/110.1; 430/108.8; 430/124.3

(58) Field of Classification Search ..... 430/108.8, 430/110.1, 124.3
See application file for complete search history.

(56) References Cited

U.S. PATENT DOCUMENTS

2005/0100808 A1* 5/2005 Hashimoto et al. ..... 430/108.8
2006/0204882 A1 9/2006 Nozaki et al.
2006/0210902 A1 9/2006 Nakamura et al.
2006/0275686 A1 12/2006 Kadota et al.
2006/0292474 A1 12/2006 Mikuriya et al.
2007/0026335 A1 2/2007 Yamamoto et al.
2007/0059625 A1 3/2007 Yamamoto et al.
2007/0122729 A1 5/2007 Katoh et al.

(Continued)

FOREIGN PATENT DOCUMENTS

JP 53-127726 11/1978

(Continued)

OTHER PUBLICATIONS

U.S. Appl. No. 11/963,279, Dec. 21, 2007, Mikuriya, et al.

(Continued)

*Primary Examiner* — Christopher Rodee
*Assistant Examiner* — Jonathan Jelsma
(74) *Attorney, Agent, or Firm* — Oblon, Spivak, McClelland, Maier & Neustadt, L.L.P.

(57) ABSTRACT

A toner useful for an oilless fixing method, includes a binder resin; a colorant; and 2.0 to 4.5% by weight of a wax which is soluble in n-hexane, based on a total weight of the toner, wherein the wax is dispersed in the toner, the wax forming wax domain particles (DA) comprising wax domain particles (DS) exposed at a surface of the toner and wax domain particles (DI) encapsulated in the toner and not exposed at the surface of the toner, wherein a weight of the DS is greater than a weight of the DI, wherein the toner from which the DS have been eluted with n-hexane comprises vestigial concavities having an area of 0.01 $\pi\mu m^2$ or more on the surface of the toner in an amount of from 1 to 7 pcs/4 $\mu m^2$, and wherein 60% or more by number of the DA having a particle diameter of 200 nm or more have a spindle or cylindrical shape having an aspect ratio of 4 or more.

19 Claims, 3 Drawing Sheets

U.S. PATENT DOCUMENTS

| | | | |
|---|---|---|---|
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |
| 2007/0217842 | A1 | 9/2007 | Kato et al. |
| 2007/0238042 | A1 | 10/2007 | Yasunaga et al. |
| 2008/0038656 | A1 | 2/2008 | Yasunaga et al. |

FOREIGN PATENT DOCUMENTS

| | | |
|---|---|---|
| JP | 62-145255 | 6/1987 |
| JP | 02-201378 | 8/1990 |
| JP | 02-221967 | 9/1990 |
| JP | 03-001162 | 1/1991 |
| JP | 2003-207925 | 7/2003 |
| JP | 2005-157343 | 6/2005 |
| JP | 2006-075668 | 3/2006 |

OTHER PUBLICATIONS

U.S. Appl. No. 12/208,801, Sep. 11, 2008, Ogawa, et al.
U.S. Appl. No. 12/241,656, Sep. 30, 2008, Yasunaga et al.
U.S. Appl. No. 12/197,651, Aug. 25, 2008, Katoh, et al.

* cited by examiner

TONER, AND OILLESS FIXING METHOD AND PROCESS CARTRIDGE USING THE TONER

BACKGROUND OF THE INVENTION

1. Field of the Invention

The present invention relates to a toner for use in electrophotography. In addition, the present invention also relates to an oilless fixing method and a process cartridge using the toner.

2. Discussion of the Background

Electrophotography is typically applied to copiers, printers, facsimiles, and the like machines. In order to make such a machine smaller in size and easier in maintainability, a developing unit mainly including a developing device, a drum unit mainly including an electrostatic latent image member, and a process cartridge integrally combining the developing unit, the drum unit, and the like unit, have been proposed recently, especially for printers and facsimiles.

The process cartridge is preferably applied to a machine employing a one-component developing method, which has an advantage in downsizing of the machine. In the one-component developing method, a one-component developer (hereinafter referred to as a "toner", unless otherwise described) is triboelectrically charged by a thickness control member (hereinafter referred to as a "blade", unless otherwise described) or a developer bearing member (hereinafter referred to as a "developing roller", unless otherwise described), and a thin layer of the toner is formed on the developing roller. The thin layer of the toner is conveyed to a developing area where the developing roller faces an electrostatic latent image bearing member so that an electrostatic latent image formed on the electrostatic latent image bearing member is developed with the toner to form a toner image.

A contact one-component developing method in which a developing roller directly or indirectly contacts an electrostatic latent image bearing member is widely used. The contact one-component developing method provides high quality images with good thin line reproducibility and image density uniformity.

In the contact one-component developing method, a toner is frictionally contacted with a toner bearing member, a charging member, or a photoreceptor. As a result, the toner and the surfaces of the toner bearing member and the photoreceptor may largely deteriorate with time especially under tough environmental conditions such as a high-temperature and high-humidity condition and a low-temperature and low-humidity condition. Therefore, there is a need for solving the above problems.

On the other hand, a fixing system (hereinafter referred to as an "oilless fixing system") without an oil applicator, configured to apply an oil to a fixing member to effectively separate a recording medium therefrom, is widely used recently. Such an oilless fixing system produces images with smooth surface.

In order to satisfactorily separate a toner having sharply-melting property from a fixing member in the oilless fixing system, the toner may include a large amount of a wax. However, such a large amount of a wax may not be well dispersed in the toner, resulting in deterioration of mechanical strength of the toner. Therefore, a contradictory problem arises that a toner including a large amount of wax easily deteriorates by application of mechanical stresses in the one-component developing method.

To solve the above-described problems, the following techniques have proposed: increasing the molecular weight of a binder resin of a toner to enhance mechanical strength of the toner; reducing dispersion particle diameters of wax particles in a pulverization toner so as to be uniformly dispersed therein; etc. In addition, a technique of completely encapsulating a wax in a toner, by a wet granulation method such as a polymerization method, for example, and controlling particle diameter and dispersion state of the wax in the toner is also proposed.

However, a toner having both satisfactory resistance to mechanical stress in a one-component developing method and satisfactory fixing property in an oilless fixing system is not yet provided. For example, if the molecular weight of a binder resin is increased to enhance mechanical strength of a toner, the toner may not satisfactorily melt when fixed, resulting in production of full-color images with weak fixing strength and poor glossiness. Furthermore, if the dispersion particle diameters of wax particles are reduced so that the wax particles are uniformly dispersed in a pulverization toner, few amount of wax particles are exposed at the surface of the toner while wax particles present inside the toner hardly bleeds out, resulting in provision of insufficient fixing property. If the amount of a wax is increased for enhancing separability of a toner, the wax may not finely dispersed in the toner. As a result, a contradictory problem arises again that mechanical strength of the toner deteriorates.

A toner completely encapsulating a wax, manufactured by a wet granulation method, exerts its separability by bleeding out the wax therefrom. Therefore, such a toner is preferably used for a fixing system with low speed and high pressure. In other words, such a toner is difficult to be used for a high-speed machine.

As another approach, published unexamined Japanese patent application No. (hereinafter referred to as JP-A) 2003-207925 discloses a toner including a binder resin and a wax having an affinity to the binder resin. A relationship between the elution amount of the wax in the case of immersing the toner in hexane and that in the case of immersing the heated toner in hexane is defined. It is disclosed therein that the amount of the wax present at the surface of the toner and the dispersion state of the wax in the toner may be optimized by the defined relationship.

JP-A 2005-157343 also discloses a toner including a binder resin and a wax, wherein the elution amount of the wax in the case of immersing the toner in hexane is defined. It is disclosed therein that the toner satisfies both durability and oilless fixability. However, the wax may bleed out from the toner too slowly because the wax has too high an affinity to the binder resin so as to be finely dispersed therein. Consequently, the toner may not exert separability in a high-speed fixing system.

To improve the separability in a high-speed fixing system, the affinity of the wax to the binder resin may be decreased so that the wax is completely incompatible with the binder resin. In this case, the wax may not be finely dispersed in the binder resin in a typical kneading process for manufacturing a pulverization toner, and therefore a part of the wax may release from the toner and form a film thereof on image forming members, and mechanical strength of the toner may decrease. As a result, the toner may satisfy neither durability nor fixability in a one-component developing method.

SUMMARY OF THE INVENTION

Accordingly, an object of the present invention is to provide a toner having both satisfactory resistance to mechanical stress in the one-component developing system and satisfactory fixing property in the oilless fixing system, preferably used for a high-speed full-color image forming.

Another object of the present invention is to provide an oilless fixing method and a process cartridge capable of producing high quality images for a long period of time.

These and other objects of the present invention, either individually or in combinations thereof, as hereinafter will become more readily apparent can be attained by the present invention, a first embodiment of which includes a toner, comprising:

a binder resin;

a colorant; and 2.0 to 4.5% by weight of a wax which is soluble in n-hexane, based on a total weight of the toner, wherein said wax is dispersed in the toner, said wax forming wax domain particles (DA) comprising wax domain particles (DS) exposed at a surface of the toner and wax domain particles (DI) encapsulated in the toner and not exposed at the surface of the toner, wherein a weight of the DS is greater than a weight of the DI, wherein the toner from which the DS have been eluted with n-hexane comprises vestigial concavities having an area of 0.01 $\pi\mu m^2$ or more on the surface of the toner in an amount of from 1 to 7 pcs/4 $\mu m^2$, and wherein 60% or more by number of the DA having a particle diameter of 200 nm or more have a spindle or cylindrical shape having an aspect ratio of 4 or more.

In another embodiment, the present invention provides an oilless fixing method using the above toner. In yet another embodiment, the present invention provides a process cartridge using the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
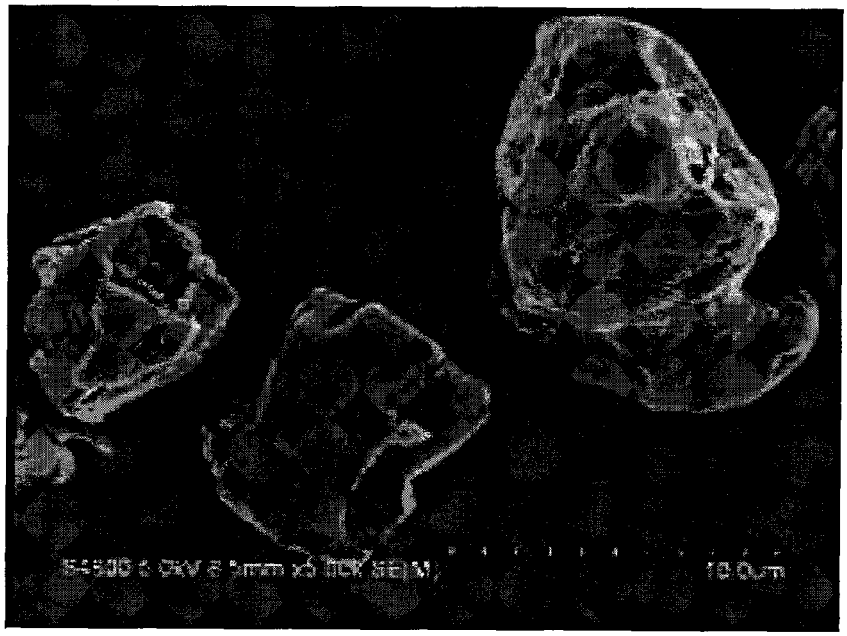
FIG. 1 is a SEM image of the toner of the present invention, from which wax domain particles exposed at the surface of the toner have been eluted with n-hexane.

Generally, the present invention provides a toner including a binder resin, a colorant, and a wax soluble in n-hexane. The wax soluble in n-hexane typically has a low polarity and a small solubility parameter (i.e., SP value). Such a wax has no affinity to the binder resin, which typically has a polarity, and therefore the wax forms domain particles thereof in the binder resin. The wax domain particles are dispersed inside the toner, or exposed at the surface of the toner.

Whether or not a wax is soluble in n-hexane is determined as follows. At first, 0.1 g of a wax and 10 g of n-hexane are poured into a 50 cc beaker, and agitated at 25° C. using a magnet stirrer. The mixture is filtered with a membrane filter having an opening of 1 μm. Thereafter, the membrane filter is dried so as to weigh insoluble components remaining on the membrane filter. The ratio by weight of the insoluble components remaining on the membrane filter to the wax poured into the beaker is calculated. When the ratio is equal to or less than 5% by weight, the wax is regarded as being soluble in n-hexane in the present invention.

As described above, the wax is dispersed in the toner forming wax domain particles (hereinafter "DA"). The wax domain particles (DA) comprise wax domain particles (hereinafter "DS") exposed at the surface of the toner and wax domain particles (hereinafter "DI") encapsulated in the toner and not exposed at the surface thereof. The toner of the present invention includes the wax (i.e., wax domain particles (DA)) in an amount of from 2.0 to 4.5% by weight based on total weight of the toner. The amount of wax in the toner includes all values and subvalues therebetween, especially including 2.2, 2.4, 2.5, 2.6, 2.8, 3, 3.2, 3.4, 3.5, 3.6, 3.8, 4, 4.2 an 4.4% by weight. When the amount is too small, the toner may have insufficient separability. When the amount is too large, the toner may have extremely poor mechanical strength. Such a toner tends to strongly adhere to a charging member in line by application of mechanical stress in a developing device, resulting in causing linear image noise.

Typically, as the amount of a wax exposed at the surface of a toner increases, separability of the toner increases while causing side effects of deterioration of mechanical strength and formation of toner film on image forming members. To solve this problem, the present inventors focus attention on the number of wax domain particles exposed at the surface of a toner with a specific exposure area, which may have an influence on separability of the toner. As a result, the present inventors found that a toner including vestigial concavities, from which wax domain particles are eluted with n-hexane, having an area of 0.01 $\pi\mu m^2$ or more on the surface thereof in an amount of from 1 to 7 pcs/4 $\mu m^2$, when observed by a scanning electron microscope (SEM), is most preferable. When the amount of the vestigial concavities is too small, the toner may have poor separability. When the amount of the vestigial concavities is too large, the toner may have poor mechanical strength and form films thereof on image forming members. In the present invention, there is no need to make consideration of wax domain particles exposed at the surface of the toner with an exposure area less than 0.01 $\pi\mu m^2$, because such a wax domain particle is less effective for both separability and mechanical strength of the toner. The number of the vestigial concavities can be determined as follows. A toner (i.e., a mother toner to which an external additive such as a silica is not added) is immersed in n-hexane, dried, and observed by a SEM. (This method will be explained in detail later.) In a case an external additive is added to the toner, the toner is previously subjected to an ultrasonic treatment in a solution including a surfactant so that the external additive is released from the toner. Similarly, the ultrasonic-treated toner is dried, immersed in n-hexane, dried again, and observed by a SEM. Thereafter, the toner is observed and photographed by a SEM at a magnification of 20,000 times. The number of vestigial concavities having a circle-equivalent diameter of 200 nm or more is determined from each of 10 views of 2-μm-square area in the photograph, and the thus obtained 10 values are averaged.

In the present invention, the "circle-equivalent diameter" of a vestigial concavity is defined as the average of the major axis and the minor axis thereof measured from the SEM image.

The vestigial concavities can be formed on the surface of a toner by a solvent extraction method as follows:

(1) 1 g of a toner is weighed using a precision balance, and poured into a 30 ml screw vial container;

(2) 7 ml of hexane is measured off by a volumetric pipet, and added to the screw vial container containing the toner;

(3) the mixture is agitated with a roller for 1 minute at a revolution of 120 rpm;

(4) the agitated mixture is filtered with a membrane filter having an opening of 1 μm, and filtrate and toner particles remaining on the membrane filter are collected;

(5) the collected toner particles remaining on the membrane filter are dried; and (6) the surface of the dried toner particles are observed by a SEM.

FIG. 1 is a SEM image of the toner of the present invention, from which wax domain particles exposed at the surface of the toner are eluted with n-hexane by the above-described method.

Next, the relationship between wax domain particles (DS) exposed at the surface of the toner and wax domain particles (DI) encapsulated in the toner and not exposed at the surface thereof will be explained. In the present invention, the weight of DS is greater than that of DI, in other words, the weight ratio of DS to DI is greater than 1 (i.e., DS/DI>1). In this case, the wax can efficiently bleed out from the toner and the toner exerts good separability even if the toner includes a small amount of the wax. The weights of DS and DI can be measured as follows. At first, a toner is subjected to differential scanning calorimetry (DSC) to measure an endothermic quantity (ΔHA) results from DA. The total amount of the wax (i.e., the amount of wax domain particles (DA)) included in the toner is calculated from the endothermic quantity (ΔHA) results from DA. Next, a predetermined amount of the toner is immersed in n-hexane so that wax domain particles (DS) exposed at the surface of the toner are eluted. The thus obtained toner from which DS are removed is subjected to differential scanning calorimetry (DSC) to measure an endothermic quantity (ΔHI) results from DI. The amount of wax domain particles (DI) encapsulated in the toner and not exposed at the surface thereof is calculated from the endothermic quantity (ΔHI) results from DI. The amount of DS can be calculated from an endothermic quantity (ΔHS) results from DS, which is the difference between ΔHA and ΔHI (i.e., ΔHS=ΔHA−ΔHI).

Figure 2:
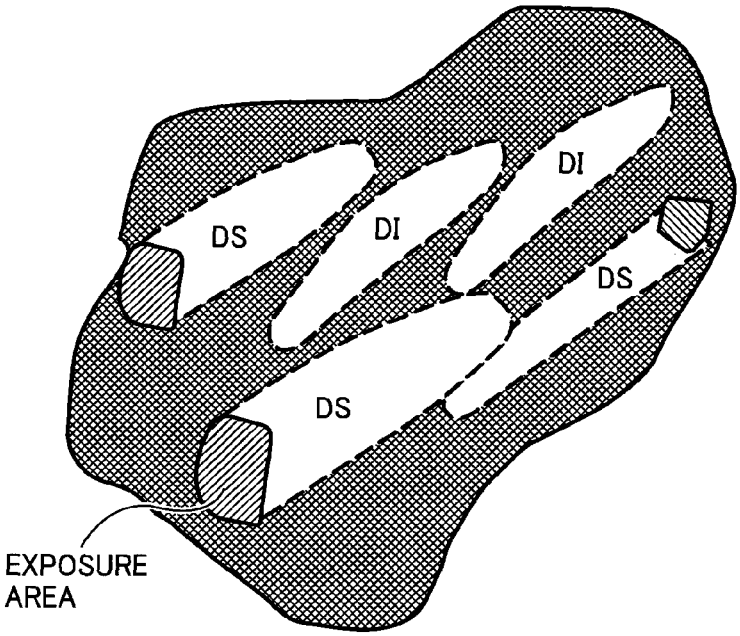
FIG. 2 is a schematic perspective view illustrating an embodiment of the toner of the present invention.

Furthermore, 60% or more by number of DA having a particle diameter of 200 nm or more have a spindle or cylindrical shape having an aspect ratio of 4 or more, preferably 5 or more. The present inventors found that when a toner includes the above-described amount of a wax, the above-described number of wax domain particles exposed at the surface of the toner with a specific exposure area, and the above-described amount of DS and DI, the wax domain particles have a needle-like, cylindrical, or spindle shape. FIG. 2 is a schematic perspective view illustrating an embodiment of the toner of the present invention. As illustrated in FIG. 2, wax domain particles (DS) are exposed at the surface of the toner with a relatively large exposure area of 0.01 $\pi\mu m^2$ or more (i.e., an area having a circle-equivalent diameter of 200 nm or more). The number of DS present on the surface of the toner is only 1 to 7 per 2-μm-square area, however, needle-like or cylindrical wax domain particles are spread over the toner. Furthermore, the number of wax domain particles (DS) exposed at the surface of the toner is greater than that of the wax domain particles (DI) encapsulated in the toner and not exposed at the surface thereof. With such a configuration, the toner of the present invention has both satisfactory strength resistant to mechanical stress applied in the one-component developing method, and satisfactory wax-bleeding ability at a time of fixation.

The shape of wax domain particle can be determined by a solvent extraction method as follows. A toner is dispersed in a mixture solvent including DMF (N,N-dimethylformamide) and chloroform. The dispersion is centrifuged so that wax domain particles are separated. The separated wax domain particles are observed with a SEM.

In the present invention, the "particle diameter" of a wax domain particle (DA) is defined as the average of the major axis and the minor axis thereof measured from the SEM image.

The toner of the present invention preferably has an endothermic curve having a maximum endothermic peak at a temperature of from 65 to 95° C. within a range of from 30 to 200° C., obtained by DSC. The endothermic peak results from a wax. When the maximum endothermic peak is observed at a temperature of from 65 to 95° C., preferably from 70 to 90° C., the toner has good combination of low-temperature fixability, hot offset resistance, and blocking resistance.

The endothermic curve can be obtained by a differential scanning calorimeter such as DSC-7 (from Perkin Elmer Japan Co., Ltd.), according to a method based on ASTM D3418-82. For example, 2 to 10 mg of a sample is precisely weighed, and poured into an aluminum pan. The aluminum pan and an empty aluminum pan for reference are heated at a temperature rising rate of 10° C./min within a temperature range of from 30 to 160° C. under normal temperature and humidity.

Further, the toner of the present invention preferably has an endothermic quantity of from 2.8 to 4.5 mJ/mg, measured by DSC. The endothermic quantity includes all values and subvalues therebetween, especially including 3, 3.2, 3.4, 3.6, 3.8, 4, 4.2 and 4.4 mJ/mg. When the endothermic quantity is too small, the wax may not exert satisfactory separability. When the endothermic quantity is too large, the wax may not be finely dispersed in the toner, and therefore the toner is easily deteriorated by mechanical stress applied in the one-component developing device.

Among various waxes soluble in n-hexane, which typically have a low polarity, hydrocarbon paraffin waxes are preferably used for the present invention. Specific examples of the hydrocarbon paraffin wax include, but are not limited to, a low-molecular-weight alkylene polymer which is obtained by a radical polymerization of an alkylene at high pressure or a polymerization of an alkylene at low pressure in the presence of a Ziegler catalyst; an alkylene polymer which is obtained by pyrolysis of a high-molecular-weight alkylene polymer; and a synthesized hydrocarbon wax obtained from a distillation residue of a hydrocarbon wax obtained by Arge method using a synthetic gas including carbon monoxide and hydrogen, or obtained by hydrogenating the distillation residue. These waxes can satisfactorily bleed out when the toner is fixed, while satisfying the above-described dispersion state in the toner.

The toner of the present invention is preferably manufactured by a pulverization method. For example, a dry mixture of raw materials of a toner is melt-kneaded by a grinding kneader (to be explained later), and the melt-kneaded mixture is cooled by a pair of cooled rollers while being quickly stretched at a high velocity.

A typical toner can be manufactured by, for example, melt-kneading toner components such as a hybrid resin in which a wax is finely dispersed, a colorant, etc. by a kneader, cooling and pulverizing the melt-kneaded mixture, and classifying the pulverized particles. The particle diameters of wax domain particles dispersed in the toner can be varied by controlling operation conditions of the kneader. A kneader capable of dispersing a wax in a toner forming wax domain particles with a relatively large size and a relatively narrow particle diameter distribution is preferably used for the present invention. For example, a grinding kneader including an external grindstone and internal grindstone is preferably used, in which a sample to be treated is introduced to a gap between the external and internal grindstones so as to be kneaded by application of rotational shearing force thereto. JP-A 2006-75668 discloses a grinding kneader including an external grindstone and an internal grindstone, preferably used for the present invention. A gap between the external and internal grindstones is variable so that the particle diameters of wax domain particles in a toner are appropriately controlled. The gap between the external and internal grindstones preferably has a distance of from 0.05 to 5 mm, and more preferably from 0.1 to 2 mm. The distance of the gap is typically variable within a range of from 0.1 to 3 mm at intervals of 0.05 mm, and is appropriately set in consideration of a balance with other conditions such as a setting temperature.

Figure 3:
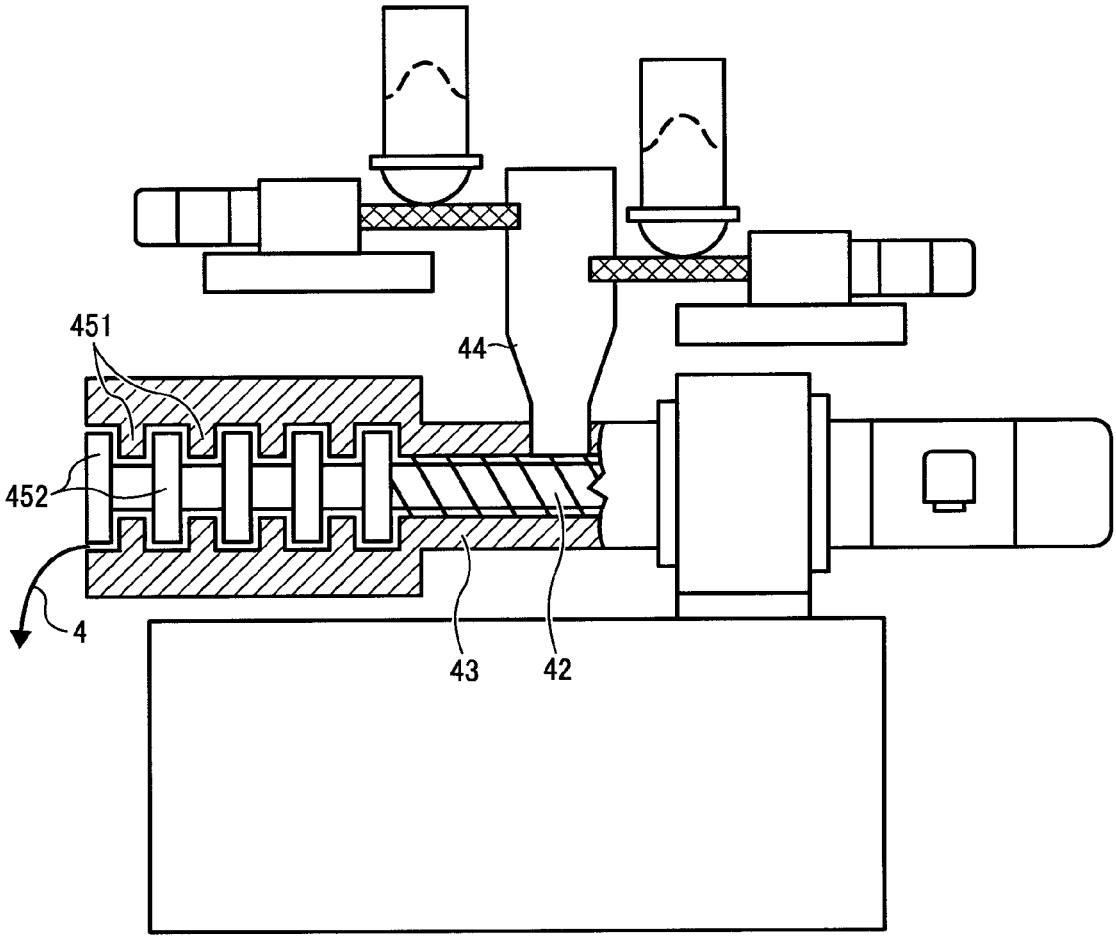
FIG. 3 is a schematic view illustrating an embodiment of a grinding kneader preferably used for the present invention.

FIG. 3 is a schematic view illustrating an embodiment of a grinding kneader preferably used for the present invention. A mixture of raw materials is poured into a feeder 44, and fed by a feed screw 42 to a thin-layer gap between an external grindstone 451 and an internal grindstone 452 to be kneaded. The kneaded mixture is fed to a discharge opening 4 through a feed part, not shown, by a feed screw, not shown, and subsequently rolled and cooled by a mill roll. The thin-layer gap between the external grindstone 451 and the internal grindstone 452, the inner temperature of a cylinder 43 including the external grindstone 451 and the internal grindstone 452, and the revolution of the feed screw 42 may be set as appropriate. Generally, as the thin-layer gap narrows, the particle diameters of wax domain particles decrease. In contrast, as the thin-layer gap widens, the particle diameters of wax domain particles increase. In the present invention, to achieve the desired particle diameter distribution of wax domain particles, the thin-layer gap between the external grindstone 451 and the internal grindstone 452 preferably has a distance of from 0.25 to 0.80 mm. The cylinder 43 preferably has an inner temperature not less than the softening point of the binder resin, and more preferably 10° C. higher than the softening point of the binder resin, in terms of dispersibility of the wax and colorant. In particular, the cylinder 43 typically has an inner temperature of from 60 to 180° C., and more preferably from 70 to 140° C. When the binder resin is a mixture resin including 2 or more resins, the softening point of the mixture resin is regarded as that of the binder resin. When the binder resin is a hybrid resin to which a wax is added, the softening point of the hybrid resin is regarded as that of the binder resin. To generate an appropriate torque, the revolution of the feed screw 42 is typically from 50 to 1000 rpm, and preferably from 60 to 90 rpm. When a mixture of raw materials is kneaded under the above-described conditions, the resultant wax domain particles have a relatively large particle diameter of from 2 to 3 μm immediately after discharged from the kneader.

To roll and cool the kneaded mixture, any known coolers equipped with a mill roll can be used. For example, a belt-shaped cooler and a drum-shaped cooler can be used. Typically, the kneaded mixture is rolled by a pair of driven mill rolls, and subsequently cooled by a belt-shaped cooler, a drum-shaped cooler, or the like, so as to be solidified. To prevent wax domain particles from reaggregating in a toner when cooled, it is undesirable to extremely narrow the gap between the mill rolls and to rapidly stretch the kneaded mixture. In contrast, in the present invention, the kneaded mixture is preferably rapidly rolled (stretched) by mill rolls when cooled. In other words, wax domain particles controlled to have a relatively large particle diameter are preferably rapidly stretched when cooled, so that the wax domain particles have a slender cylindrical shape with a diameter of from 100 to 300 nm and a height of from 3 to 8 μm immediately after being cooled. Thus, the toner of the present invention can be obtained. A belt cooler manufactured by Nippon Belting Co., Ltd. is preferably used for the present invention.

The binder resin preferably includes a first binder resin having a softening point of from 90 to 120° C., and a second binder resin having a softening point of from 120 to 140° C. in an amount of from 40 to 75% by weight based on the first binder resin. The toner of the present invention is preferably used for a non-magnetic one-component developing device or method.

In order that the toner has better separability and offset resistance in an oilless fixing system, the binder resin much more preferably includes a first binder resin having a softening point of from 100 to 120° C., and a second binder resin having a softening point of from 120 to 140° C. in an amount of from 50 to 75% by weight based on the first binder resin. Furthermore, the first binder resin preferably has a softening point of from 105 to 115° C., and the second binder resin preferably has a softening point of from 125 to 135° C. The ratio of the second binder resin to the first binder resin is preferably from 50 to 75% by weight.

The softening point is defined as the $T_{1/2}$ temperature determined from a flow curve obtained by a CFT-500D flowtester (from Shimadzu Corporation) under the following conditions: the die orifice has a diameter of 0.50 mm and a length of 1.0 mm; the temperature rising rate is 3.0° C./min; and the test pressure is 30 kgf.

From the viewpoint of improving heat resistance of the toner, the first and second binder resins each have a glass transition temperature of from 50 to 75° C., and more preferably 55 to 70° C. When the binder resin is a mixture resin including 2 or more resins, the glass transition temperature of the mixture resin is regarded as that of the binder resin.

The glass transition temperature can be measured by a differential scanning calorimeter such as DSC6200 (from Seiko Instruments Inc.) as follows. A sample is heated to 200° C., subsequently cooled to 0° C. at a temperature decreasing rate of 10° C./min, and finally heated at a temperature rising rate of 10° C./min. The measurement result is analyzed to determine the glass transition temperature of a resin or a toner.

The first binder resin preferably comprises a polycondensation resin such as a polyester resin obtained by a polycondensation of a polyalcohol with a polycarboxylic acid. For example, a polyester resin obtained by a polycondensation of an alkylene oxide adduct of bisphenol A (serving as a polyalcohol) with at least one of terephthalic acid and fumaric acid (serving as a polycarboxylic acid) is preferably used.

The second binder resin preferably comprises a polycondensation resin such as a polyester resin obtained by a polycondensation of an alcohol with a carboxylic acid, at least one of which has 3 or more valences. For example, a polyester resin obtained by a polycondensation of an alkylene oxide adduct of bisphenol A (serving as a divalent alcohol) with trimellitic acid (serving as a carboxylic acid having 3 or more valences) and at least one of terephthalic acid, fumaric acid, and dodecenyl succinic acid (serving as a divalent carboxylic acid) is preferably used.

Further, the second binder resin preferably comprises a hybrid resin comprising a polyester resin unit and a vinyl resin unit. A hybrid resin is obtained by mixing raw material monomers of a polyester resin and raw material monomers a vinyl resin with monomers capable of reacting with both the raw material monomers of a polyester resin and the raw material monomers of a vinyl resin in a reaction vessel, and simultaneously subjecting all the monomers to a condensation polymerization reaction for forming the polyester resin unit and a radical polymerization reaction for forming the vinyl resin unit. The toner including a hybrid resin has good stiffness, fixability, and offset resistance, and a wax can be finely dispersed in the toner.

Monomers for preparing the second binder resin preferably include raw material monomers of a vinyl resin in an amount of from 5 to 30% by weight, and more preferably from 10 to 25% by weight.

From the viewpoint of improving hot offset resistance of the toner, the second binder resin preferably includes tetrahydrofuran-insoluble components in an amount of from 0.1 to 30% by weight, and more preferably from 0.1 to 10% by weight.

With the above-described configuration of the binder resin, a kneaded mixture of toner components is hardly cut off even when is rapidly stretched and cooled.

The toner of the present invention may be fixed on a recording medium by the oilless fixing method of the present invention, including passing a recording medium having a toner image thereon through a part where a pressing member or a pressing-heating member contacts and presses a heating member such as a heating roller.

The surface of the heating member preferably includes a fluorocarbon resin such as tetrafluoroethylene-perfluoroalkyl vinyl ether copolymer (PFA), polytetrafluoroethylene (PTFE), and polyvinylidene fluoride.

An oilless fixing device employing the above-described oilless fixing method preferably includes a heating roller serving as the heating member and a pressing roller serving as the pressing member. In particular, the oilless fixing device preferably includes the heating roller, the pressing roller to press the heating roller, and a separation plate to separate a recording medium having a fixed image thereon from the heating roller. The heating roller typically includes an aluminum cored bar including a heater, and an elastic layer and a surface layer formed thereon. The pressing roller typically includes an aluminum cored bar, and an elastic layer and a surface layer formed thereon. The elastic layer preferably includes a silicone rubber, but not limited thereto. The surface layer preferably includes a fluorocarbon resin, more preferably PFA, but not limited thereto.

A nip is formed at a portion where the pressing roller contacts and presses the heating roller. The nip is preferably convex upward from the viewpoint of improving separability. With such a configuration, a recording medium is prevented from winding around the heating roller when a toner image is fixed thereon.

The above-described oilless fixing method of the present invention provides high quality images with high reproducibility and separability.

The process cartridge of the present invention is preferably used for an image forming apparatus in which an electrostatic latent image formed on a photoreceptor is developed with a toner to form a toner image, and the toner image is transferred onto a transfer member. The process cartridge is detachably attachable to such an image forming apparatus, and comprises a photoreceptor configured to bear an electrostatic latent image; a developing device configured to develop the electrostatic latent image with the toner of the present invention; and at least one of a charger configured to charge the photoreceptor, provided in contact with the photoreceptor; a latent image forming device configured to form the electrostatic latent image on the photoreceptor; a transfer device configured to transfer the toner image onto a transfer member; a cleaning device configured to remove residual toner particles remaining on the photoreceptor after the toner image is transferred onto the transfer member.

Figure 4:
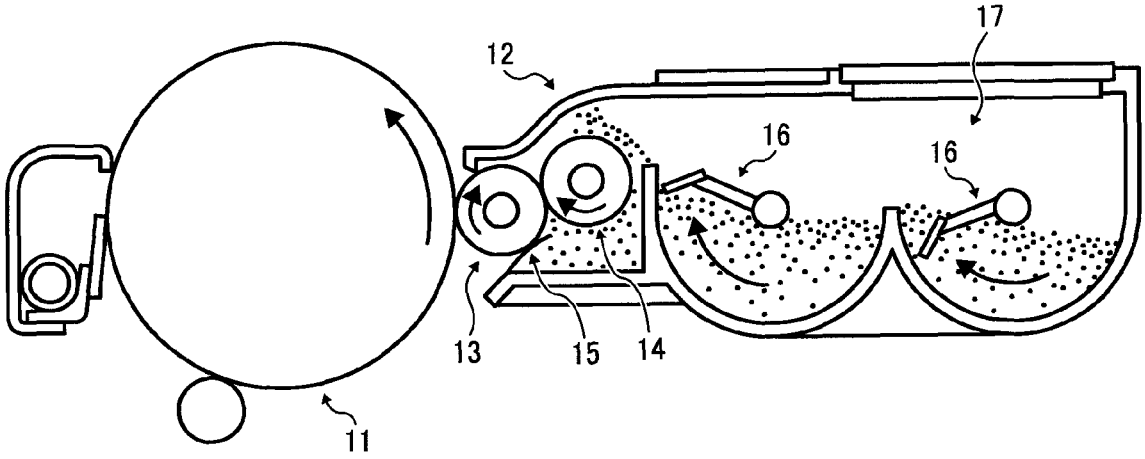
FIG. 4 is a schematic view illustrating an embodiment of the process cartridge of the present invention.

FIG. 4 is a schematic view illustrating an embodiment of the process cartridge of the present invention. The process cartridge illustrated in FIG. 4 includes a photoreceptor 11 and a developing device 12 including a developing roller 13, a supply roller 14, a layer control member 15, toner feed shafts 16, and a toner containing chamber 17.

A preferred embodiment of the developing device 12 will be explained in detail.

The developing roller 13 includes a roller, an elastic rubber layer covering the roller, and a surface coating layer including a material chargeable to a polarity opposite to that of a toner formed on the elastic rubber layer. In order to prevent a toner from being deteriorated by application of intensive pressure from the layer control member 15, the elastic rubber layer preferably has a JIS-A hardness not greater than 60 degrees. In order to bear a desired amount of a toner, the developing roller 13 preferably has a surface roughness Ra of from 0.3 to 2.0 μm. Since a developing bias is applied to the developing roller 13 to form an electric field between the photoreceptor 11, the elastic rubber layer preferably has a resistance of from $10^3$ to $10^{10}\Omega$. The developing roller 13 rotates in a clockwise direction so as to convey a toner borne on the surface thereof to the layer control member 15 and a point facing the photoreceptor 11.

The layer control member 15 is provided on a lower position than a point where the developing roller 13 contacts the supply roller 14. The layer control member 15 includes a spring member including a metallic plate of SUS, phosphor bronze, etc., and a free end thereof contacts the surface of the developing roller 13 with a pressing force of from 10 to 40 N/m. When toner particles pass through the layer control member 15 under pressure, a layer of the toner particles is formed while the toner particles are triboelectrically charged. Furthermore, a control bias, having a value in which the developing bias is offset in the same direction as the charge polarity of the toner, is applied to the layer control member 15 so as to assist triboelectric charging of the toner.

Specific preferred examples of suitable elastic rubbers used for the developing roller 13 include, but are not limited to, styrene-butadiene copolymer rubbers, acrylonitrile-butadiene copolymer rubbers, acrylic rubbers, epichlorohydrin rubbers, urethane rubbers, silicone rubbers, and blend rubbers including 2 or more of the above describer rubbers. Among these rubbers, a blend rubber including an epichlorohydrin rubber and an acrylonitrile-butadiene copolymer rubber is preferably used.

The developing roller 13 can be manufactured by, for example, covering an outer circumferential surface of a conductive shaft with an elastic rubber. The conductive shaft includes, for example, a metal such as stainless.

Alternatively, the developing roller 13 may include a metallic conductive material such as aluminum and stainless, the surface of which is sandblasted so as to have a reasonable roughness. Alternatively, the layer control member 15 may include a plate spring material to which a plate of a rubber such as a urethane rubber and a silicone rubber is attached, or a blade of a metallic material such as SUS. The supply roller 14 and the layer control member 15 are provided around the developing roller 13.

The toner feed shafts 16, which are rotatable, are provided in the toner containing chamber 17 so as to supply the toner to the supply roller 14.

A charging member included in the charger for use in the present invention includes a cored bar, a conductive layer formed on the cored bar, and a surface layer formed on the conductive layer, thereby forming a cylindrical shape. A voltage is applied to the cored bar from a power supply, and subsequently applied to an image bearing member (i.e., a photoreceptor) through the conductive layer and the surface layer so that the surface of the image bearing member is charged.

The cored bar of the charging member is provided in a longitudinal direction of the image bearing member, in other words, provided in parallel with an axis of the image bearing member. The charging member is pressed on the image bearing member with a predetermined pressing force. With such a configuration, a part of the image bearing member is in contact with a part of the charging member in longitudinal directions thereof, forming a contact nip therebetween. The image bearing member is driven to rotate by a driving device. Thereby, the charging member is driven to rotate.

The image bearing member is charged by the power source through a vicinity of the contact nip. The surface of the charging member evenly contacts a chargeable surface of the image bearing member, having a width equivalent to the length of the charging member, with the contact nip therebetween.

The conductive layer includes a nonmetal, such as a conductive vulcanized rubber. In order to stably contact the image bearing member, a material having a low hardness is preferably used. Specific examples of such materials include, but are not limited to, resins such as polyurethane, polyether, and polyvinyl alcohol and rubbers such as epichlorohydrin, EPDM, and NBR. The conductive layer further includes a conductive material such as carbon black, graphite, titanium oxide, and zinc oxide.

The surface layer includes a material having a medium resistance of from $10^2$ to $10^{10}\Omega$, such as a polyurethane-silicone acrylic polymer containing acetylene black.

Specific examples of suitable resins used for the surface layer include, but are not limited to, nylon, polyamide, polyimide, polyurethane, polyester, silicone, TEFLON®, polyacetylene, polypyrrole, polythiophene, polycarbonate, and polyvinyl. Fluorocarbon resins typically having a large water contact angle are preferably used.

Specific examples of the fluorocarbon resins include, but are not limited to, polyvinylidene fluoride, polyethylene fluoride, vinylidene fluoride-tetrafluoroethylene copolymer, and vinylidene fluoride-tetrafluoroethylene-hexafluoropropylene copolymer.

The surface layer may optionally include a conductive material such as carbon black, graphite, titanium oxide, zinc oxide, tin oxide, and iron oxide, so as to have a medium resistance.

The photoreceptor 11 rotates from a lower side to an upper side at a point facing the developing roller 13. The developing roller 13 is driven while forming a gap of from 0.1 to 0.3 mm between the photoreceptor 11.

The configuration of the toner of the present invention will be explained.

The mother toner of the present invention comprises a binder resin and a colorant. Specific examples of the binder resins include, but are not limited to, any known resins typically used for electrophotography and electrostatic printing such as styrene resins, acrylic resins such as alkyl acrylates and alkyl methacrylates, styrene-acrylic copolymer resins, polyester resins, silicone resins, olefin resins, amide resins, and epoxy resins.

When the toner is used for an oilless full-color fixing system, a first binder resin including a high-molecular-weight resin with elasticity and a second binder resin including a low-molecular-weight resin with sharply melting property are preferably used in combination, in terms of improvement of separability and image glossiness.

Specific preferred examples of suitable first and second resins include, but are not limited to, any known resins typically used for full-color toners such as polyester resins, (meth)acrylic resins, styrene-(meth)acrylic copolymer resins, epoxy resins, and COC (i.e., cyclic olefin resins such as TOPAS-COC from Ticona). Among these, polyester resins are preferably used for both the first and second resins, in terms of improvement of fixability in an oilless fixing system.

A polyester resin obtained by a polycondensation of a polyalcohol with a polycarboxylic acid is preferably used for the present invention. Specific examples of divalent alcohols include, but are not limited to, alkylene oxide adducts of bisphenol A (e.g., polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane), ethylene glycol, diethylene glycol, triethylene glycol, 1,2-propylene glycol, 1,3-propylene glycol, 1,4-bitanediol, neopentyl glycol, 1,4-butenediol, 1,5-pentanediol, 1,6-hexandiol, 1,4-cyclohexanedimethanol, dipropylene glycol, polyethylene glycol, polytetramethylene glycol, bisphenol A, and hydrogenated bisphenol A. Specific examples of alcohols having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of divalent carboxylic acids include, but are not limited to, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrides and lower alkyl esters of the above-described carboxylic acids.

Specific examples of carboxylic acids having 3 or more valences include, but are not limited to, 1,2,4-benzenetricarboxylic acid (i.e., trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and anhydrides and lower alkyl esters of the above-described carboxylic acids The polyester resin preferably used for the present invention further includes a vinyl polyester resin obtained by mixing raw material monomers of a polyester resin and raw material monomers of a vinyl resin with monomers capable of reacting with both the raw material monomers of a polyester resin and the raw material monomers of a vinyl resin in a reaction vessel, and simultaneously subjecting all the monomers to a condensation polymerization reaction for forming the polyester resin unit and a radical polymerization reaction for forming the vinyl resin unit. The monomers capable of reacting with both the raw material monomers of a polyester resin and the raw material monomers a vinyl resin are, in other words, monomers both condensation-polymerizable and radical-polymerizable. In particular, such a monomer includes a carboxyl group which is condensation-polymerizable and a vinyl group which is radical-polymerizable. Specific examples of the condensation-polymerizable and radical-polymerizable monomers include, but are not limited to, fumaric acid, maleic acid, acrylic acid, and methacrylic acid.

Specific examples of the raw material monomers of a polyester resin include, but are not limited to, the above-described polyalcohols and polycarboxylic acids. Specific examples of the raw material monomers of a vinyl resin include, but are not limited to, styrenes and styrene derivatives (e.g., styrene, o-methylstyrene, m-methylstyrene, p-methylstyrene, α-methylstyrene, p-ethylstyrene, 2,4-dimethylstyrene, p-tert-butylstyrene, p-chlorostyrene), ethylene-type unsaturated monoolefins (e.g., ethylene, propylene, butylene, isobutylene), alkyl methacrylates (e.g., methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate), alkyl acrylates (e.g., methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate), unsaturated carboxylic acids (e.g., acrylic acids, methacrylic acids, itaconic acid, maleic acid), acrylonitrile, maleates, itaconates, vinyl chloride, vinyl acetate, vinyl benzoate, vinyl methyl ethyl ketone, vinyl hexyl ketone, vinyl methyl ether, vinyl ethyl ether, and vinyl isobutyl ether. Specific examples of polymerization initiators for polymerizing the raw material monomers of a vinyl resin include, but are not limited to, azo and diazo polymerization initiators (e.g., 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile) and peroxide polymerization initiators (e.g., benzoyl peroxide, dicumyl peroxide, methyl ethyl ketone peroxide, isopropyl peroxycarbonate, lauroyl peroxide).

The above-described polyester resins are preferably used for the first and second binder resins. Among these resins, to more improve separability and offset resistance in an oilless fixing system, the following particular resins are more preferably used as the first and second binder resins.

As the first binder resin, a polyester resin obtained by a polycondensation of a polyalcohol with a polycarboxylic acid is more preferably used, and a polyester resin obtained by a polycondensation of an alkylene oxide adduct of bisphenol A (serving as the polyalcohol) with terephthalic acid and fumaric acid (serving as polycarboxylic acids) is much more preferably used.

As the second binder resin, a vinyl polyester resin obtained from an alkylene oxide adduct of bisphenol A, terephthalic acid, trimellitic acid, and succinic acid (serving as raw material monomers of a polyester resin); styrene and butyl acrylate (serving as raw material monomers of a vinyl resin); and fumaric acid (serving as condensation-polymerizable and radical-polymerizable monomers) is more preferably used.

The wax may be previously dispersed in the first and/or second binder resins, if desired. In particular, the wax is preferably dispersed in the first binder resin, because the first binder resin easily receive a shear when kneaded in a process of manufacturing a pulverization toner. To obtain the first binder resin in which the wax is dispersed, raw material monomers of the first binder resin may be polymerized in the presence of the wax. For example, when the first binder resin is a polyester resin, raw material monomers of the polyester resin such as an acid monomer and an alcohol monomer are subjected to a condensation polymerization in the presence of a wax. When the first binder resin is a vinyl polyester resin, raw material monomers of a polyester resin are mixed with a wax, and raw material monomers of a vinyl resin are dropped therein, while agitating and heating the mixture, so that the monomers are subjected to a condensation polymerization and a radical polymerization at the same time.

The weight ratio of the first binder resin (including the wax) to the second binder resin is preferably from 20/80 to 45/55, and more preferably from 30/70 to 40/60. When the ratio of the first binder resin is too small, the toner may have poor separability and hot offset resistance. When the ratio of the first binder resin is too large, the toner may have poor thermostable preservability and the resultant image may have poor glossiness.

The binder resin including the first and second binder resin at the above-described ratio preferably has a softening point of from 100 to 125° C., and more preferably from 105 to 125° C.

Specific examples of the colorant for use in the present invention include, but are not limited to, carbon black, aniline blue, chalco oil blue, chrome yellow, Ultramarine Blue, DU PONT Oil Red, Quinoline Yellow, Methylene Blue Chloride, copper phthalocyanine, Malachite Green Oxalate, Lamp Black, Rose Bengal, C. I. Pigment Red 48:1, C. I. Pigment Red 122, C. I. Pigment Red 57:1, C. I. Pigment Red 184, C. I. Pigment Red 269, C. I. Pigment Red 150, C. I. Pigment Red 146, C. I. Pigment Yellow 97, C. I. Pigment Yellow 12, C. I. Pigment Yellow 17, C. I. Solvent Yellow 162, C. I. Pigment Yellow 180, C. I. Pigment Yellow 93, C. I. Pigment Yellow 185, C. I. Pigment Yellow 74, C. I. Pigment Yellow 155, C. I. Pigment Blue 15:1, and C. I. Pigment Blue 15:3. The colorant is preferably combined with a resin to be used as a master batch, or previously finely dispersed in the binder resin by a flushing method. The toner preferably includes the colorant in an amount of from 2 to 15 parts by weight based on 100 parts by weight of the binder resin.

Specific examples of the wax for use in the present invention include any known waxes soluble in n-hexane. Among these waxes, a low-melting-point paraffin, having a low polarity and high separability, is preferably used.

The wax for use in the present invention preferably has an endothermic curve having a maximum endothermic peak at a temperature of from 65 to 95° C., more preferably from 70 to 90° C., and much more preferably from 70 to 80° C., within a range of from 30 to 200° C., obtained by differential scanning calorimetry (DSC).

The glass transition temperature can be measured by a differential scanning calorimeter such as DSC6200 (from Seiko Instruments Inc.) as follows, for example. A sample is heated to 200° C., subsequently cooled to 0° C. at a temperature decreasing rate of 10° C./min, and finally heated at a temperature rising rate of 10° C./min. The measurement result is analyzed to determine the glass transition temperature of a wax.

The maximum endothermic peak depends on the kind of the wax used in the toner. When the maximum endothermic peak is observed within the above-described temperature range, the toner has both good fixability and durability in a one-component developing device. Of course, 2 or more waxes can be used in combination, so long as at least one of which has a maximum endothermic peak within the above-described temperature range.

When the toner has a maximum endothermic peak at a temperature less than 50° C., the toner may have poor preservability and developability, and fogging and toner scattering may be caused. In contrast, when the toner has a maximum endothermic peak at a temperature greater than 95° C., the toner may have poor fixability at low temperatures because plasticity thereof is poor. Further, the wax may not sufficiently intervene between a fixing member and the toner when the temperature of the fixing member decreases in a continuous printing, resulting in winding of a transfer paper around the fixing member.

The maximum endothermic peak preferably has a half bandwidth of not greater than 15° C., and more preferably not greater than 7° C. When the half bandwidth is too large, the wax has a low crystallinity and a low hardness, and therefore the wax may contaminate a photoreceptor and a charging member.

The toner preferably includes the wax in an amount of from 2.0 to 4.5 parts by weight, based on 100 parts by weight of the toner. When the amount of the wax is too small, the toner may have poor separability, and therefore a transfer paper may not be well discharged and wind around a fixing member, when the temperature of the fixing member decreases. When the amount of the wax is too large, the wax may not be finely dispersed in the toner and may contaminate a charging member and a photoreceptor, resulting in occurrence of fogging.

The toner of the present invention may optionally include a charge controlling agent, if desired. Any known charge controlling agents can be used. In particular, colorless charge controlling agents which can be rapidly charged and stably keep a specific amount of charge are preferably used.

Specific examples of negative charge controlling agents include, but are not limited to, metallic compounds of salicylic acid, naphthoic acid, dicarboxylic acid, and derivatives thereof; polymeric compounds having sulfonic acid or carboxylic acid in a side chain thereof; boron compounds; urea compounds; silicon compounds; and calixarenes. Specific examples of positive charge controlling agents include, but are not limited to, quaternary ammonium salts; polymeric compounds having a quaternary ammonium salt in a side chain thereof; guanidine compounds; and imidazole compounds. These charge controlling agents can be used alone or in combination.

Specific examples of commercially available usable negative charge controlling agents include, but are not limited to, chromium complex salt-type azo dyes such as BONTRON® S-32, 33, 34, 35, 37, 38, and 40 (from Orient Chemical Industries, Ltd.), AIZENSPIRON BLACK TRH and BHH (from Hodogaya Chemical Co., Ltd.), KAYASET BLACK T-22 and 004 (from Nippon Kayaku Co., Ltd.), copper phthalocyanine dyes such as BONTRON® S-39 (from Orient Chemical Industries, Ltd.), chromium complex salts such as BONTRON® E-81 and 82 (from Orient Chemical Industries, Ltd.), zinc complex salts such as BONTRON® E-84 (from Orient Chemical Industries, Ltd.), aluminum complex salts such as BONTRON® E-86 (from Orient Chemical Industries, Ltd.), boron complex salts including a benzilic acid derivative such as LR-147 (from Japan Carlit Co., Ltd.), and calixarene compounds. Specific preferred examples of suitable negative charge controlling agents used for full-color toners include, but are not limited to, metal complexes of zinc or chromium with salicylic acid derivatives, calixarene compounds, organic boron compounds including a benzilic acid derivative, and fluorine-containing quaternary ammonium salts. These compounds are colorless, whitish, or light-colored charge controlling agents that may not deteriorate color tone and transparency of the resultant full-color toner. Specific examples of the metal complexes of salicylic acid derivatives include, but are not limited to, compounds disclosed in JP-As 53-127726 and 62-145255. Specific examples of the calixarene compounds include, but are not limited to, compounds disclosed in JP-A 02-201378. Specific examples of the organic boron compounds include, but are not limited to, compounds disclosed in JP-A 02-221967. Specific examples of the fluorine-containing quaternary ammonium salts include, but are not limited to, compounds disclosed in JP-A 03-1162.

Further, metallic soaps and inorganic and organic metallic salts can be used in combination with the above-described compounds. Specific examples of the metallic soaps include, but are not limited to, aluminum tristearate; aluminum distearate; stearates of barium, calcium, lead, and zinc; linolenates of cobalt, manganese, lead, and zinc; octanoates of aluminum, calcium, and cobalt; oleates of calcium and cobalt; zinc palmitate; naphthenates of calcium, cobalt, manganese, lead, and zinc; and salts of an acid group of a resin with calcium, cobalt, manganese, lead, and zinc. Specific examples of cationic components included in the inorganic and organic metallic salts include, but are not limited to, Ia, IIa, and IIIa group metals in the periodic series. Specific examples of anionic components included in the inorganic and organic metallic salts include, but are not limited to, halogens, carbonates, acetates, sulfates, borates, and phosphates.

The toner preferably includes the charge controlling agent in an amount of from 0.1 to 10 parts by weight based on 100 parts by weight of the binder resin. However, the toner of the present invention does not necessarily include the charge controlling agent because the toner can be triboelectrically charged with a carrier in a two-component developing method, and with a blade member or a sleeve member in a non-magnetic one-component blade coating developing method, without the charge controlling agent.

The toner of the present invention may include an external additive. Specific examples of the external additive include, but are not limited to, any known commercially available materials such as silica, alumina, and titanium. These materials can be used alone or in combination. These materials are preferably hydrophobized so as to improve environmental stability thereof. Specific examples of hydrophobizing agents include, but are not limited to, silane coupling agents, titanate coupling agents, aluminum coupling agents, zircoaluminate coupling agents, silicone oils, and silicone varnishes. The specific surface area of the above-described materials and the kind of the hydrophobized agent may be selected from the viewpoint of fluidity, transferability, and charging stability of the resultant toner.

Specific examples of the silane coupling agents include, but are not limited to, hexamethyldisilazane, trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, and vinyltriacetoxysilane. Specific examples of the silicone oils include, but are not limited to, dimethylpolysiloxane, methylhydrogenpolysiloxane, and methylphenylpolysiloxane.

The surface of a mother material (e.g., silica, titania) can be treated with the above-described hydrophobizing agent by the following methods, for example: a dry method in which the hydrophobizing agent is diluted with a solvent, the diluted solution is mixed with the mother material, and the mixture is heated, dried, and pulverized; and a wet method in which the mother material is dispersed in an aqueous medium to prepare a slurry, the hydrophobizing agent is added thereto, and the mixture is heated, dried, and pulverized.

The toner of the present invention may preferably include a particulate inorganic material as the external additive for improving fluidity, developability, and chargeability. The particulate inorganic material preferably has a primary particle diameter of from 5 mμ to 2 μm, and more preferably from 5 mg to 500 mg; and a specific surface area obtained by BET (Brunauer, Emmett, and Teller) method of from 20 to 500 $m^2/g$. The toner preferably includes the particulate inorganic material in an amount of from 0.01 to 5% by weight, and more preferably from 0.01 to 2.0% by weight, based on total weight of the toner. Specific examples of the particulate inorganic material include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Furthermore, the toner of the present invention may preferably include a particulate polymer as the external additive. Specific examples of the particulate polymers include, but are not limited to, fine particles of polystyrenes manufactured by a method such as soap-free emulsion polymerization, suspension polymerization, and dispersion polymerization; methacrylates, acrylates, and copolymers thereof; silicone resins; polycondensation resins such as benzoguanamine and nylon; and thermosetting resins.

The above-described external additives may be surface-treated to improve hydrophobicity, so that fluidity and chargeability of the toner do not deteriorate even in high-humidity conditions.

Specific examples of surface-treatment agents include, but are not limited to, silane coupling agents, silylation agents, silane coupling agents having a fluorinated alkyl group, organic titanate coupling agents, aluminum coupling agents, silicone oils, and modified silicone oils.

The toner of the present invention may optionally include a cleanability improving agent which adds good cleaning properties to the toner such that the toner remaining on the surface of a photoreceptor or a primary transfer member even after a toner image is transferred can be easily removed.

Specific examples of such a cleanability improving agents include, but are not limited to, metal salts of fatty acids such as zinc stearate and calcium stearate; and particulate polymers such as polymethyl methacrylate and polystyrene, which are manufactured by a method such as soap-free emulsion polymerization methods. In particular, particulate resins having a relatively narrow particle diameter distribution and a volume average particle diameter of from 0.01 μm to 1 μm are preferably used as the cleanability improving agent.

The toner of the present invention may optionally include a particulate resin capable of forming an aqueous dispersion thereof. The particulate resin may be both of a thermoplastic resin and a thermosetting resin. Specific preferred examples of suitable resins include, but are not limited to, vinyl resins, polyurethane resins, epoxy resins, polyester resins, polyamide resins, polyimide resins, silicone resins, phenol resins, melamine resins, urea resins, aniline resins, ionomer resins, and polycarbonate resins. These resins can be used alone or in combination. Among these resins, vinyl resins, polyurethane resins, epoxy resins, polyester resins, and combinations of theses resins are preferably used, in terms of ease of forming an aqueous dispersion of fine particles thereof.

The toner of the present invention can be manufactured by any known toner manufacturing methods including dry methods (e.g., a pulverization method) and wet methods (e.g., an emulsion aggregation method, a suspension polymerization method, a dissolution suspension method). Dry methods typically produce irregular-shaped toner particles, on the other hand, wet methods typically produce spherical toner particles. The shape of toner is determined depending on an image forming process for which the toner is used. The toner of the present invention preferably has a volume average particle diameter of from 4 to 10 μm, and more preferably from 5 to 10 μm, in terms of improvement of image quality.

The toner of the present invention may be manufactured by a typical pulverization method including a mixing process for mechanically mixing toner components such as a binder resin, a wax, and a colorant, a melt-kneading process for melt-kneading the mixture, a rolling-cooling process for rolling and cooling the kneaded mixture, a pulverization process for pulverizing the rolled mixture, and a classification process for classifying the pulverized particles. Particles having an undesired particle diameter which are produced in the pulverization and classification processes may be recycled in the mixing and melt-kneading processes.

As described above, the toner of the present invention is preferably manufactured using a grinding kneader, a two-roll mill, and a belt cooler, as illustrated in FIG. 1, in the melt-kneading and rolling-cooling processes. The manufacturing conditions are determined so that the maximum wax domain particle dispersed in the rolled mixture has a diameter of from 200 to 300 nm a height of from 3 to 6 μm. The size and shape of the wax domain particle are evaluated by the solvent extraction method described above.

The toner is preferably mixed with the external additive using a dry mixer such as a HENSCHEL MIXER. To remove foreign substances, the toner is preferably sieved with a mesh having an opening not greater than 100 μm after addition of the external additive.

The particle diameter of a toner can be measured using an instrument such as COULTER COUNTER TA-II, COULTER MULTISIZER II, and COULTER MULTISIZER III (from Beckman Coulter K. K.), for example.

The typical measuring method is as follows:

(1) 0.1 to 5 ml of a surfactant (preferably an alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the weight and number of toner particles in the toner suspension liquid are measured by the above instrument using an aperture of 100 μm to determine the weight and number distribution thereof; and (4) the weight average particle diameter (Dv) and the number average particle diameter (Dn) are determined from the weight and number distributions, respectively.

The shape of a toner particle is preferably determined by an optical detection method such that an image of the particle is optically detected by a CCD camera and analyzed. A particle suspension passes the image detector located on the flat plate so as to be detected.

The circularity of a particle is determined by the following equation:

$$\text{Circularity}=Cs/Cp$$

wherein Cp represents the length of the circumference of the projected image of a particle and Cs represents the length of the circumference of a circle having the same area as that of the projected image of the particle.

The average circularity of a toner can be determined using a flow-type particle image analyzer FPIA-2000 manufactured by Sysmex Corp. The typical measurement method is as follows:

(1) 0.1 to 0.5 ml of a surfactant (preferably alkylbenzene sulfonate) is included as a dispersant in 100 to 150 ml of water from which solid impurities have been removed;

(2) 0.1 to 0.5 g of a toner is added thereto and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are determined by the measuring instrument mentioned above.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Resin H1

The following vinyl monomers are contained in a dropping funnel: 600 parts of styrene, 110 parts of butyl acrylate, 30 parts of acrylic acid, and 30 parts of dicumyl peroxide (i.e., polymerization initiator).

The following polyester monomers are contained in a 5-liter four-necked flask equipped with a thermometer, a stainless stirrer, a flow-down condenser, and a nitrogen inlet pipe: 1230 parts of polyoxypropylene(2,2)-2,2-bis(4-hydroxyphenyl) propane, 290 parts of polyoxyethylene(2,2)-2,2-bis(4-hydroxyphenyl)propane, 250 parts of isododecyl succinic anhydride, 310 parts of terephthalic acid, 180 parts of 1,2,4-benzenetricarboxylic anhydride, and 7 parts of dibutyltin oxide (i.e., esterification catalyst). The four-necked flask is set in a mantle heater, and the mixture is heated to 160° C. under nitrogen atmosphere while agitated. The mixture of the vinyl monomers and the polymerization initiator is dropped therein from the dropping funnel over a period of 1 hour. The mixture is subjected to an addition polymerization reaction for 2 hours at 160° C., and subsequently subjected to a condensation polymerization reaction at 230° C. The polymerization degree is traced by measuring the softening point of the product by a constant-load capillary rheometer, and the reaction is terminated when the product has a desired softening point. Thus, a resin H1, having a softening point (T½) of 130° C., is prepared.

Preparation of Resin L1

The procedure for preparing the resin H1 is repeated except that the vinyl monomers are not added, and the amount of the polyester monomers are changed as follows: 1650 parts of polyoxypropylene(2,2)-2,2-bis(4-hydroxyphenyl)propane, 660 parts of polyoxyethylene(2,2)-2,2-bis(4-hydroxyphenyl) propane, 190 parts of isododecyl succinic anhydride, 750 parts of terephthalic acid, 190 parts of 1,2,4-benzenetricarboxylic anhydride, and 0.3 parts of dibutyltin oxide (i.e., esterification catalyst). Thus, a resin L1, having a softening point (T½) of 113° C., is prepared.

Examples 1 to 6 and Comparative Examples 1 to 7

Toners 1 to 13 each are prepared by a pulverization method as follows: 30 parts if the resin H1, 70 parts of the resin L1, 2.5 parts of a colorant (a copper phthalocyanine blue pigment), and a wax described in Table 1 are mixed using a blender, respectively. The mixture is melt-kneaded, rolled, cooled, pulverized, and classified under a manufacturing condition described in Table 2, respectively. The toner properties of the thus prepared toners 1 to 13 are shown in Table 3.

TABLE 1

| | Toner | Wax Kind | Melting Point (° C.) | Amount (% by weight) |
|---|---|---|---|---|
| Example 1 | 1 | Paraffin | 65 | 3.5 |
| Example 2 | 2 | Paraffin | 72 | 3.5 |
| Example 3 | 3 | Paraffin | 82 | 3.5 |
| Example 4 | 4 | Paraffin | 91 | 3.5 |
| Example 5 | 5 | Paraffin | 72 | 2.2 |
| Example 6 | 6 | Paraffin | 72 | 4.5 |
| Comparative Example 1 | 7 | Paraffin | 72 | 3.5 |
| Comparative Example 2 | 8 | Paraffin | 72 | 3.5 |
| Comparative Example 3 | 9 | Paraffin | 72 | 3.5 |
| Comparative Example 4 | 10 | Carnauba | 80 | 3.5 |
| Comparative Example 5 | 11 | Ester | 82 | 3.5 |
| Comparative Example 6 | 12 | Paraffin | 72 | 1.8 |
| Comparative Example 7 | 13 | Paraffin | 72 | 5 |

TABLE 2

| | Toner | Kneader | Cooling Condition |
|---|---|---|---|
| Example 1 | 1 | Grinding kneader* | High-speed stretching |
| Example 2 | 2 | Grinding kneader* | High-speed stretching |
| Example 3 | 3 | Grinding kneader* | High-speed stretching |
| Example 4 | 4 | Grinding kneader* | High-speed stretching |
| Example 5 | 5 | Grinding kneader* | High-speed stretching |
| Example 6 | 6 | Grinding kneader* | High-speed stretching |
| Comparative Example 1 | 7 | Oven roll kneader | High-speed stretching |
| Comparative Example 2 | 8 | Twin-screw extruder | High-speed stretching |
| Comparative Example 3 | 9 | Grinding kneader* | Normal |
| Comparative Example 4 | 10 | Grinding kneader* | High-speed stretching |
| Comparative Example 5 | 11 | Oven roll kneader | High-speed stretching |
| Comparative Example 6 | 12 | Oven roll kneader | High-speed stretching |
| Comparative Example 7 | 13 | Oven roll kneader | High-speed stretching |

*a grinding kneader disclosed in JP-A 2006-75668

TABLE 3

| | Toner | Toner Properties: DSC Peak Temperature (° C.) | DSC Endothermic Quantity (mJ/mg) | Number of Vestigial Concavities (pcs/4 μm²) | Weight Ratio (DS/DI) | Number of Spindle or Cylindrical DA particles** (% by number) |
|---|---|---|---|---|---|---|
| Ex. 1 | 1 | 66.3 | 3.6 | 5.1 | 1.5 | 66 |
| Ex. 2 | 2 | 73.2 | 3.7 | 4.8 | 1.4 | 70 |
| Ex. 3 | 3 | 82.9 | 3.6 | 4.4 | 1.3 | 65 |
| Ex. 4 | 4 | 90.3 | 3.5 | 4.4 | 1.3 | 80 |
| Ex. 5 | 5 | 73.2 | 2.8 | 2.3 | 1.1 | 72 |
| Ex. 6 | 6 | 73.2 | 4.2 | 6.3 | 1.8 | 70 |
| Comp. Ex. 1 | 7 | 73.2 | 3.8 | 0.1 | 0.3 | —*** |
| Comp. Ex. 2 | 8 | 73.2 | 3.7 | 0.9 | 0.9 | 60 |
| Comp. Ex. 3 | 9 | 73.2 | 3.6 | 3 | 2.1 | 20 |
| Comp. Ex. 4 | 10 | 80.8 | 4 | 3.2 | 1.2 | 60 |
| Comp. Ex. 5 | 11 | 83.5 | 3.9 | 1.2 | 0.8 | 60 |
| Comp. Ex. 6 | 12 | 73.2 | 2 | 0.7 | 1 | —*** |
| Comp. Ex. 7 | 13 | 73.2 | 4.9 | 7.3 | 2 | 80 |

**The ratio (% by number) of spindle or cylindrical DA particles having a particle diameter of 200 nm or more and an aspect ratio of 4 or more, measured by observing 5,000 wax domain particles separated from the solvent extraction method using a SEM at a magnification of 5,000 times. 5 views are observed and the values are averaged.
***DA particles having a particle diameter of 200 nm or more do not exist.

Preparation of One-Component Developers 1 to 13

To prepare a one-component developer, 100 parts of each of the above-prepared toner is mixed with 1.0 part of a hydrophobized silica R974 (from Nippon Aerosil Co., Ltd.) and 1.0 part of a hydrophobized silica 90G (from Nippon Aerosil Co., Ltd.) treated with a hexamethylenedisilazane, having a BET specific surface area of 65 $m^2/g$, a pH of 6.0, and a hydrophobic degree of not less than 65%, using a HENSCHEL MIXER for 90 seconds at a revolution of 30 m/sec. The mixture is sieved with a mesh having an opening of 75 μm. Thus, one-component developers 1 to 13 are prepared.

Evaluations

The fixing property and durability of the above-prepared developers are evaluated as follows.

(1) Separability

Each of the above-prepared developers is set in a full-color printer LP-3000C (from Seiko Epson Corporation) employing a non-magnetic one-component developing method. An unfixed 36 mm-wide band-like solid image including 1.0±0.1 $mg/cm^2$ of the toner is formed on A4-size paper at a position of 3 mm behind the tip thereof while sheets of the A4-size paper are fed in the vertical direction. The unfixed image is fixed using the following fixing device at various temperatures under a high-temperature (i.e., 27° C.) and a high-humidity (i.e., 80% RH) condition to determine a fixable temperature range, in which the toner is well separated from a heating roller and offset does not occur. A transfer paper TYPE 6200 (from Ricoh Co., Ltd.) having a cross direction is used as the A4-size paper.

The fixing device used for the evaluation includes a soft roller having a fluorinated outermost layer, and drives at a revolution of 125 mm/sec. A heating roller has an outer diameter of 40 mm, and includes an aluminum cored bar, an elastic layer with a thickness of 1.5 mm including a silicone rubber and an outermost layer including PFA both formed on the aluminum cored bar, and a heater mounted inside the aluminum cored bar. A pressing roller has an outer diameter of 35 mm, and includes an aluminum cored bar, an elastic layer with a thickness of 3 mm including a silicone rubber and an outermost layer including PFA both formed on the aluminum cored bar. A nip having a width of 7 mm is formed between the heating roller and the pressing roller. The fixing device further includes a separation plate to separate a sheet having a fixed toner image thereon from the heating roller. A fixing oil is not applied to the heating roller. The fixability is graded as follows.

Good: The fixable temperature range is 50° C. or more.

Average: The fixable temperature range is 30° C. or more and less than 50° C.

Poor: The fixable temperature range is less than 30° C.

(2) High-Speed Separability

The above-described evaluation is repeated except for changing the velocity of the fixing device from 125 mm/sec to 250 mm/sec.

(3) Durability (Toner Film and Black Spot)

Each of the above-prepared developers is set in the full-color printer LP-3000C (from Seiko Epson Corporation). An image having an image proportion of 6% is continuously formed on 1,000 sheets of paper under a high-temperature (i.e., 27° C.) and high-humidity (i.e., 80% RH) condition. Thereafter, the photoreceptor and the intermediate transfer belt are visually observed whether or not a toner film and/or a black spot occur. The durability is graded in terms of the occurrence of toner film and/or black spot as follows.

Good: Neither toner film nor black spot is observed on both of the photoreceptor and the intermediate transfer belt. No problem in practical use.

Average: Either toner film and black spot are observed on at least one of the photoreceptor and the intermediate transfer belt, but neither toner film nor black spot is observed on the resultant image. No problem in practical use.

Poor: Either toner film and black spot are observed on both of the photoreceptor and the intermediate transfer belt, and the resultant image. Having a problem in practical use.

(4) Durability (Toner Adherence)

Similarity to the evaluation described above, an image having an image proportion of 6% is continuously formed on 1,000 sheets of paper under a high-temperature (i.e., 27° C.) and high-humidity (i.e., 80% RH) condition. Thereafter, the developing sleeve and the resultant image are visually observed whether or not undesired toner particles are adhered thereto. The durability is graded in terms of the adherence of undesired toner particles as follows.

Good: No toner particle is adhered to the developing sleeve.

Average: A slight amount of toner particles are linearly or unevenly adhered to the developing sleeve, but no undesired toner particles are linearly adhered to the resultant image. No problem in practical use.

Poor: A large amount of toner particles are linearly or unevenly adhered to the developing sleeve. Furthermore, an unusual sound and toner spilling occur. Having a problem in practical use.

The evaluation results are shown in Table 4.

TABLE 4

| | | Durability | | Fixing property | |
|---|---|---|---|---|---|
| | Toner | Toner Film/ Black Spot | Toner Adherence | Separability | High-speed Separability |
| Ex. 1 | 1 | Good | Good | Good | Good |
| Ex. 2 | 2 | Good | Good | Good | Good |
| Ex. 3 | 3 | Good | Good | Good | Good |
| Ex. 4 | 4 | Good | Good | Good | Good |
| Ex. 5 | 5 | Good | Good | Good | Good |
| Ex. 6 | 6 | Good | Good | Good | Good |
| Comp. Ex. 1 | 7 | Good | Good | Good | Poor |
| Comp. Ex. 2 | 8 | Good | Good | Good | Poor |
| Comp. Ex. 3 | 9 | Poor | Poor | Good | Good |
| Comp. Ex. 4 | 10 | Good | Good | Good | Poor |
| Comp. Ex. 5 | 11 | Good | Good | Good | Poor |
| Comp. Ex. 6 | 12 | Good | Good | Poor | Poor |
| Comp. Ex. 7 | 13 | Poor | Poor | Good | Good |

This document claims priority and contains subject matter related to Japanese Patent Application No. 2007-069763, filed on Mar. 19, 2007, the entire contents of which are incorporated herein by reference.

Having now fully described the invention, it will be apparent to one of ordinary skill in the art that many changes and modifications can be made thereto without departing from the spirit and scope of the invention as set forth therein.

The invention claimed is:

1. A toner, comprising:

a binder resin;

a colorant; and 2.0 to 4.5% by weight of a wax which is soluble in n-hexane, based on a total weight of the toner, wherein said wax is dispersed in the toner, said wax forming wax domain particles (DA) comprising wax domain particles (DS) exposed at a surface of the toner and wax domain particles (DI) encapsulated in the toner and not exposed at the surface of the toner, wherein a weight of the DS is greater than a weight of the DI, wherein the toner from which the DS have been eluted with n-hexane comprises vestigial concavities having an area of 0.01 $\pi\mu m^2$ or more on the surface of the toner in an amount of from 1 to 7 pcs/4 $\mu m^2$, and wherein 60% or more by number of the DA having a particle diameter of 200 nm or more have a spindle or cylindrical shape having an aspect ratio of 4 or more.

2. The toner according to claim 1, wherein the toner has an endothermic curve within a range of from 30 to 200° C. having a maximum endothermic peak at a temperature of from 65 to 95° C., obtained by DSC.

3. The toner according to claim 1, wherein the toner has an endothermic quantity of from 2.8 to 4.5 mJ/mg, obtained by DSC.

4. The toner according to claim 1, wherein the wax comprises a hydrocarbon paraffin wax.

5. The toner according to claim 1, manufactured by a method comprising:

melt-kneading a dry mixture of the binder resin, the colorant, and the wax with a grinding kneader; and cooling and rapidly stretching the melt-kneaded mixture with a pair of cooled rollers.

6. The toner according to claim 1, wherein the binder resin comprises:

a first binder resin having a softening point of from 90 to 120° C.; and a second binder resin having a softening point of from 120 to 140° C. in an amount of from 40 to 70% by weight based on the first binder resin.

7. The toner according to claim 6, wherein the second binder resin comprises a hybrid resin comprising a polycondensation resin skeleton and a vinyl resin skeleton.

8. The toner according to claim 7, wherein the polycondensation resin skeleton comprises a polyester resin skeleton.

9. The toner according to claim 1, wherein the toner has a softening point of from 115 to 130° C.

10. An oilless fixing method, comprising:

forming a toner image on a recording medium with the toner according to claim 1;

passing the recording medium having the toner image thereon through a portion where a pressing member or a pressing-heating member contacts and presses a heating member.

11. The method according to claim 10, wherein the toner has an endothermic curve within a range of from 30 to 200° C. having a maximum endothermic peak at a temperature of from 65 to 95° C., obtained by DSC.

12. The method according to claim 10, wherein the toner has an endothermic quantity of from 2.8 to 4.5 mJ/mg, obtained by DSC.

13. The method according to claim 10, wherein the wax comprises a hydrocarbon paraffin wax.

14. The method according to claim 10, wherein the binder resin comprises:

a first binder resin having a softening point of from 90 to 120° C.; and a second binder resin having a softening point of from 120 to 140° C. in an amount of from 40 to 70% by weight based on the first binder resin.

15. The method according to claim 14, wherein the second binder resin comprises a hybrid resin comprising a polycondensation resin skeleton and a vinyl resin skeleton.

16. The method according to claim 15, wherein the polycondensation resin skeleton comprises a polyester resin skeleton.

17. The method according to claim 10, wherein the toner has a softening point of from 115 to 130° C.

18. The method according to claim 10, wherein a surface of the heating member comprises a fluorocarbon resin.

19. The method according to claim 10, which proceeds in an oilless fixing device comprising a heating roller, a pressing roller to press the heating roller, and a separation plate to separate the recording medium having a fixed image thereon from the heating roller.

* * * * *